US005893258A

United States Patent [19]

Lancaster, III

[11] Patent Number: 5,893,258

[45] Date of Patent: Apr. 13, 1999

[54] BUILDING AND WRAPPING A STABILIZED LOAD

[75] Inventor: Patrick R. Lancaster, III, Louisville, Ky.

[73] Assignee: Lantech Technology Investment Corp., Wilmington, Del.

[21] Appl. No.: 08/770,780

[22] Filed: Dec. 20, 1996

[51] Int. Cl.[6] ..... B65B 13/04; B65B 13/20; B65B 35/50

[52] U.S. Cl. ..... 53/399; 53/438; 53/447; 53/587; 53/529; 53/540; 414/907

[58] Field of Search ..... 414/907, 788; 53/529, 540, 587, 588, 399, 438, 447

[56] References Cited

U.S. PATENT DOCUMENTS

| | | | |
|---|---|---|---|
| 3,885,678 | 5/1975 | Borg et al. | 214/1 BB |
| 3,941,048 | 3/1976 | Oe et al. | 414/907 X |
| 4,067,456 | 1/1978 | Schmitt | 414/907 X |
| 4,132,318 | 1/1979 | Wang et al. | 214/1 BB |
| 4,271,755 | 6/1981 | Kintgen et al. | 414/907 X |
| 4,439,084 | 3/1984 | Werkheiser | 53/540 X |
| 4,450,668 | 5/1984 | Grossi | 53/587 X |
| 4,555,050 | 11/1985 | Krieger et al. | 212/211 |
| 4,593,517 | 6/1986 | Mattila | 53/441 |
| 4,934,123 | 6/1990 | Salzsauler | 53/399 |
| 4,938,008 | 7/1990 | Salzsauler | 53/556 |
| 4,993,209 | 2/1991 | Haloila | 53/399 |
| 4,995,224 | 2/1991 | Yourgalite et al. | 53/540 |
| 5,005,335 | 4/1991 | Yourgalite et al. | 53/399 |
| 5,045,303 | 9/1991 | Becicka et al. | 53/540 |
| 5,107,657 | 4/1992 | Diehl et al. | 53/588 |
| 5,163,808 | 11/1992 | Tsubone et al. | 414/907 X |
| 5,240,139 | 8/1993 | Chirnomas | 221/2 |
| 5,311,725 | 5/1994 | Martin et al. | 53/556 |
| 5,315,809 | 5/1994 | Gordon et al. | 53/399 |
| 5,336,042 | 8/1994 | Winski et al. | 414/789.5 |
| 5,372,472 | 12/1994 | Winski et al. | 414/786 |
| 5,390,476 | 2/1995 | Morantz | 53/556 |
| 5,404,691 | 4/1995 | Scherer | 53/399 |
| 5,423,163 | 6/1995 | Wendt | 53/556 |
| 5,445,493 | 8/1995 | Yourgalite et al. | 414/791.6 |
| 5,623,808 | 4/1997 | Franklin et al. | 53/399 |

FOREIGN PATENT DOCUMENTS

| | | | |
|---|---|---|---|
| 0 645 305 A1 | 3/1995 | European Pat. Off. | B65B 11/02 |
| 39 12 852 A1 | 11/1989 | Germany | B65B 11/02 |
| 93 11 247.5 | 9/1993 | Germany | B65B 11/02 |
| 162438 | 9/1983 | Japan | 414/907 |
| 8801528 | 1/1990 | Netherlands | 414/907 |

*Primary Examiner*—Linda Johnson
*Attorney, Agent, or Firm*—Finnegan, Henderson, Farabow, Garrett & Dunner, L.L.P.

[57] ABSTRACT

A method of building and stretch wrapping loads of layers of load units that includes the steps of providing at least one layer of load units in a load building and wrapping area, applying horizontal compression to the at least one layer, subsequently applying vertical compression to the at least one layer while applying the horizontal compression, releasing the horizontal compression while retaining the vertical compression, rotating the at least one layer relative to a packaging material dispenser to apply packaging material around the at least one layer while retaining the vertical compression, and releasing the vertical compression.

17 Claims, 10 Drawing Sheets

BUILDING AND WRAPPING A STABILIZED LOAD

BACKGROUND OF THE INVENTION

The present invention relates to building and wrapping a load, and more particularly to stretch wrapping a load.

Commercial products are often packaged together in a load and subsequently wrapped for transportation from a manufacturing facility. Machines that build a load of layers of products onto a pallet are generally known as palletizers. A conventional palletizer is fed product from an infeed conveyor and accumulates a single layer of product onto a plate. Once the layer is accumulated, the layer is deposited onto the pallet. This process is repeated until the desired number of layers are positioned on the pallet to build a load. Machines which then wrap the sides of a load with a web of stretch material to cover and contain the load are generally known as stretch wrapping machines. Upon completion of building a load of product on a pallet, the pallet is removed from the palletizer and transported to the stretch wrapper by a fork truck, an automated guided vehicle, a pallet car, a conveyor belt, or other transport mechanism.

Several problems can result from this process of building and wrapping a load of products, particularly when using deformed or unsquare load units. For example, typical load units include cardboard packaging material having flaps that fold over one another and interconnect to form a buldging load unit. As the load units are stacked, the deformations of the deformed, buldging packages become additive and can result in an unstable load.

As layers of these products are added, the load becomes more unstable, causing difficulty in transporting the load to a wrapping area or wrapping the load. Keeping the products and the layers of products in alignment particularly becomes more difficult as taller loads are built, moved, and wrapped. The forces exerted on the load by movement, the stretch wrap, and the centrifugal forces caused by rotation of the load during wrapping can result in misaligned product layers, and loads that will not stay together during transport or wrapping.

In addition, while stacking load units in columns produces a less crushable load, it can result in an unstable load. Therefore, load units typically are stacked in an interlocking brick-like configuration which provides more stability but which is more easily crushable because, in an interlocking brick-like configuration, the tops of the load units receive considerable forces that are unaligned with the edges of the load units. This requires the packaging of each load unit to be of greater strength than column stacking and results in more expensive, rigid packaging material than in column stacking.

SUMMARY OF THE INVENTION

An object of the invention is to provide a load building and wrapping apparatus that efficiently builds loads of layers of products and stretch wraps the loads, and overcomes the various disadvantages and drawbacks of conventional apparatus and methods just described. Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a method of building and stretch wrapping loads of layers of load units. The method includes the steps of providing at least one layer of load units in a load building and wrapping area, applying horizontal compression to the at least one layer, subsequently applying vertical compression to the at least one layer while applying the horizontal compression, releasing the horizontal compression while retaining the vertical compression, rotating the at least one layer relative to a packaging material dispenser to apply packaging material around the at least one layer while retaining the vertical compression, and releasing the vertical compression.

According to another aspect of the invention, the invention comprises an apparatus for building and wrapping a load that includes a packaging material dispenser for dispensing packaging material, means for providing relative rotation between the packaging material dispenser and the load in a load building and wrapping area for wrapping the packaging material around the load, a layer transporter for transporting load layers from the layer building area to the load building and wrapping area, a side compressor for applying horizontal compression to the load, a vertical compressor for applying vertical compression to the load, and a controller for actuating the side compressor, subsequently actuating the vertical compressor while continuing to actuate the side compressor, subsequently deactivating the side compressor while continuing to actuate the vertical compressor, and subsequently deactivating the vertical compressor.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention.

FIGS. 2–9 are side views of another embodiment of a load building and wrapping apparatus according to the present invention, indicating the sequence of operations thereof;

FIGS. 2A–9A are top views of the apparatus shown in FIGS. 2–9 respectively, indicating the sequence of operations thereof.

DESCRIPTION OF THE PREFERRED EMBODIMENTS

Figure 1:
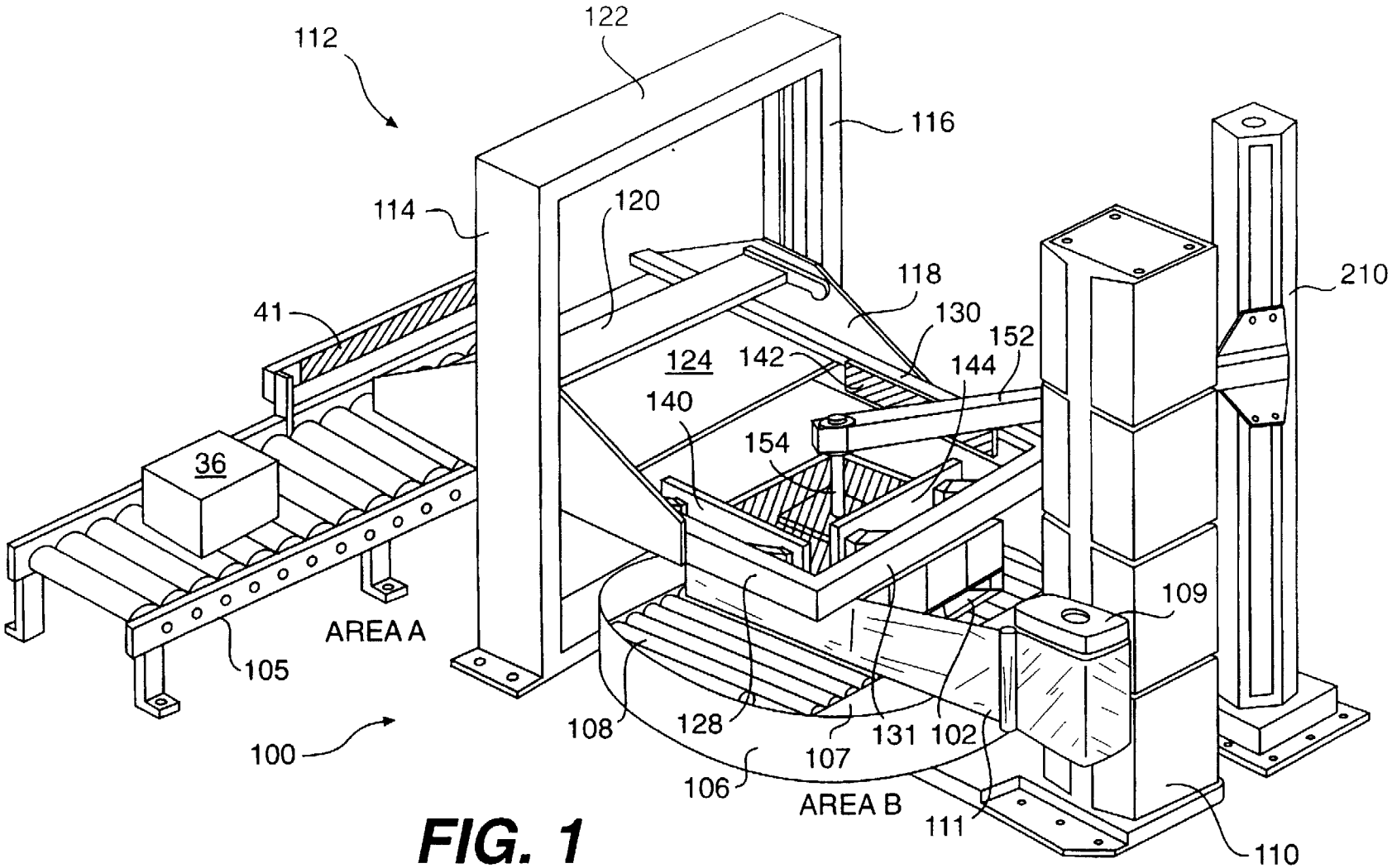
FIG. 1 is an isometric view of an embodiment of a load building and wrapping apparatus according to the present invention.

Reference will now be made in detail to the present preferred embodiments of the invention, examples of which are illustrated in the accompanying drawings. Wherever possible, the same reference numbers will be used throughout the drawings to refer to the same or like parts.

The present invention relates to a method and apparatus for load building and wrapping that builds layers of products from load units, builds a load from those layers, and stretch wraps the layers of the load. During the load building and stretch wrapping, the apparatus applies horizontal compressive forces to the sides of the layers of the load so as to eliminate spaces between load units, hold the load together, and thereby build a tightly packaged load. Vertical compressive forces may also be applied to the load to hold the horizontal compression in place while stretch wrap is being applied to the load, as will be more fully described below.

Generally, the building of a load entails two steps: layer building and load building. Layer building is the accumulation of load units from an infeed conveyor onto a palletizer. Load building is the stacking of the prepared layers to a desired height for subsequent wrapping. The stretch wrapping generally entails rotating the load relative to a stretch wrap packaging material dispensing apparatus to wrap the stretch wrap around the sides of the load. Packaging of the load may also require additional steps, such as placing cornerboards or top and bottom caps on the load to protect corners of the load or add column strength, banding the wrapped load, or covering the top of the load with a top sheet of film or other materials.

As mentioned, the load building and wrapping apparatus and related method according to the present invention applies horizontal and vertical compression forces to layers of load units during the load building and/or the stretch wrapping process. This overcomes load stabilization problems that would otherwise occur while transporting layers of load units to the stretch wrapper and during wrapping of the load. In addition, while a layer of load units is being stretch wrapped, a subsequent layer may be prepared in a layer building area. This reduces the amount of cycle time lost while waiting for a load to be wrapped.

In the preferred embodiments of the present invention and according to an aspect of the invention, the load units may be stacked in columns due to the added stability provided by the horizontal and vertical forces applied to keep the load units aligned. Aligning the load units in columns decreases the cost of packaging materials because the forces affecting the load are applied through the edges and corners of the load units, which are stronger than the tops of the load units. Because the corners of each load unit inherently bear more force, packaging material requiring less strength and rigidity, and therefore less cost, may be used in column stacking than in interlocking brick-like stacking.

As mentioned, applying horizontal compression eliminates spaces between the load units, and applying vertical compression holds the horizontal compression during wrapping. This prevents shifting of the load units and the formation of spaces between the load units during the stretch wrapping operation. In addition, because vertical forces compress the load and hold the horizontal compression, it is possible to have level layers packed tightly together, eliminating the problems associated with deformed, buldging load units described earlier.

A description of the preferred embodiments of the apparatus for building and wrapping a load according to the present invention will now be described, to be followed by a description of the related methods of building and wrapping a load using these apparatuses.

FIG. 1 shows a first embodiment of a load building and wrapping apparatus 100 according to an aspect of the present invention. Apparatus 100 includes a conventional turntable 106 having an upper conveying surface 107 with a plurality of powered rollers 108. Turntable 106 is positioned proximate to a mast 110 of a conventional stretch wrapping apparatus. Mast 110 carries a stretch wrap packaging material dispenser 109 that dispenses stretch wrap packaging material 111 around a load assembled onto a pallet 102 and rotated by turntable 106. Relative rotation may also be accomplished by rotating the dispenser around a stationary load.

An infeed conveyor 105 conveys load units 36 to a layer building area A. A palletizer 112 is positioned in layer building area A proximate infeed conveyor 105. Palletizer 112 includes legs 114 and 116, and an upper cross beam 122 connecting legs 114 and 116. Palletizer 112 supports a slider plate frame 118 having guide rails 128 and 130, a slider plate 124, and a stripper bar 120. Slider plate 124 is mounted on guide rails 128 and 130 by rollers, a telescopic drawer pull arrangement, or other suitable mechanism to permit slider plate 124 to slide along guide rails 128 and 130 in a horizontal direction from layer building area A to a load building area B. Stripper bar 120 lowers from an at-rest position shown in FIG. 1 to a displaced position by a mechanical actuator, such as a pneumatic mechanism or other suitable mechanism. A pusher bar 41 proximate conveyor 105 pushes load units 36 in a direction transverse to infeed conveyor 105 and onto slider plate 124 to form layers of load units on slider plate 124.

Guide rails 128 and 130 are connected by a cross beam 131 and are vertically moveable on legs 114 and 116 by motor-driven chain lifts or other suitable elevating mechanisms. This permits vertical displacement of slider plate 124 so as to place prepared layers of load units onto either a pallet 102, a previously deposited layer, or a slip sheet (i.e. cardboard or plastic sheet used for stability during transport), at varying heights on turntable 106.

In the embodiment shown in FIG. 1, slider plate 124 moves along guide rails 128 and 130 to displace horizontally from layer building area A to load building area B. Both guide rails 128 and 130 extend through load building area B. In another embodiment, not shown, slider plate 124 may extend from one guide rail, such a guide rail 130, so that slider plate 124 is cantilevered by rollers, or other suitable means, such as cam followers, wheels, slide blocks, etc., that permit slidable movement between slider plate 124 and guide rail 130. In such an embodiment, only one of the guide rails, such as guide rail 128, extends through load building area B so that the other guide rail, guide rail 130, does not interfere with the stretch wrapping apparatus during the stretch wrapping operation. In yet another embodiment not shown, slider plate 124 may extend from both guide rails 128 and 130 by any suitable means so that both guide rails do not interfere with the stretch wrapping apparatus.

With reference once again to the FIG. 1 embodiment, slider plate frame 118 also includes means for applying horizontal compression to a layer of load units. As shown, frame 118 includes side squeezer plates 140 and 142 respectively attached to guide rails 128 and 130 for horizontally compressing a layer of load units 36. A front squeezer plate 144 is attached to crossbeam 131 and is also used to horizontally compress a layer. Squeezer plates 140, 142, and 144 move in a back and forth motion in the horizontal plane to apply the horizontal compression to the layer and may be actuated by a pneumatic, hydraulic, or electric motor.

Figures 2, 2A:
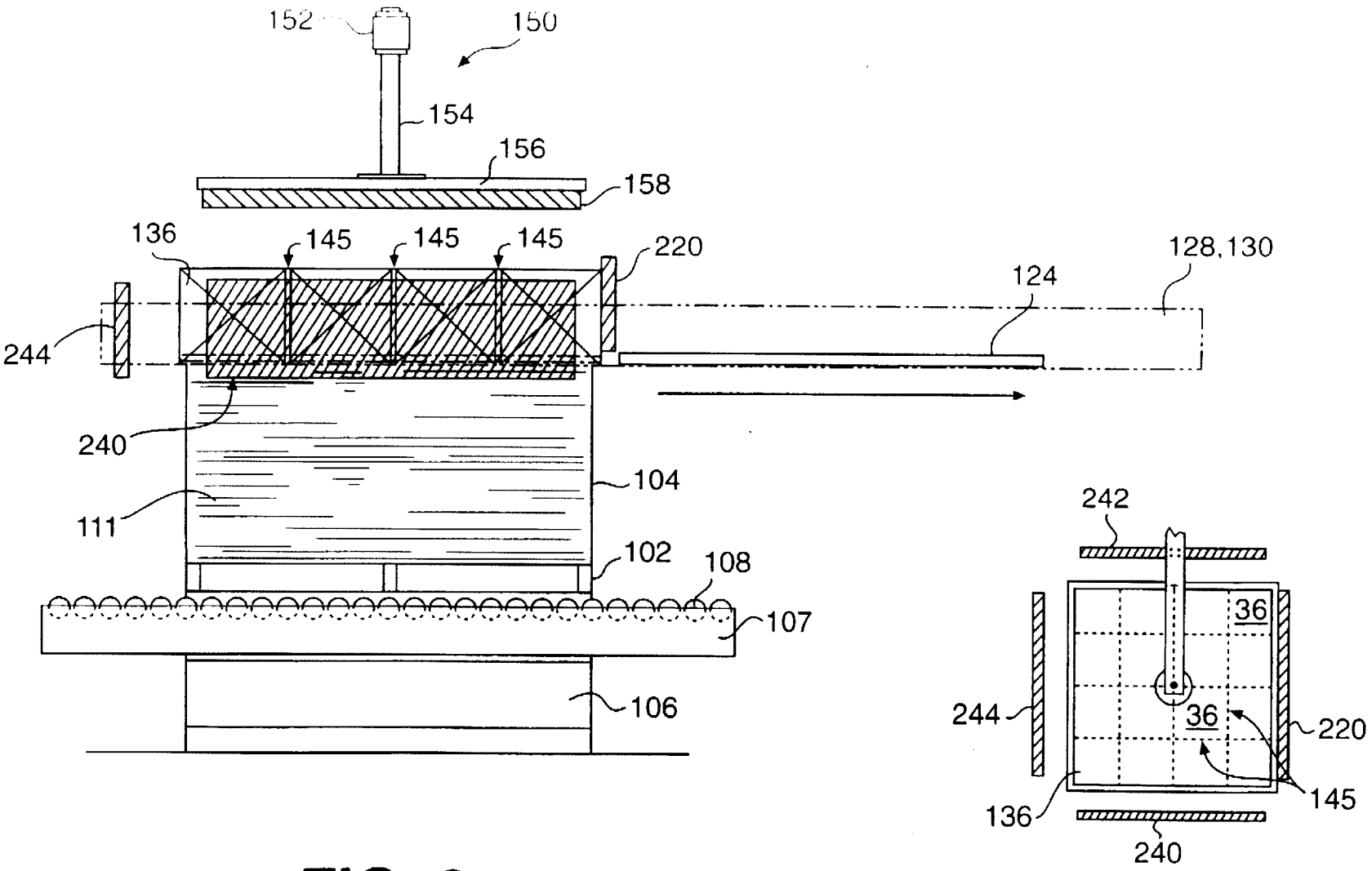

It is to be understood that the means for providing the horizontal compression, for example the horizontal side squeezers and the front squeezer shown in FIG. 1, may be attached to or arranged proximate with the load building and wrapping apparatus in a variety of ways. For example, the squeezers may be attached to a separate frame or actuating mechanism. FIG. 2 generally shows a schematic in which side squeezers 240 and 242, and front squeezer 244 are attached to a separate frame.

As with the side and front squeezers in the FIG. 1 embodiment, side and front squeezers 240, 242, and 244, and stripper bar 220, are movable in both the horizontal and vertical directions. Horizontal side squeezers 240 and 242, and front squeezer 244 may be of any size such that they compress only one layer 136 of a load 104 built on pallet 102, or compress an entire side of load 104. In the embodiment shown in FIGS. 2–9, the squeezers apply horizontal compression to a layer 136 of load units 36 after layer 136 has been placed on pallet 102 or on top of other layers.

In another embodiment, not shown, clamps located on slider plate frame 118 may lower to clasp layer 136 once layer 136 is placed on slider plate 124. The clamps compress layer 136 by grasping each corner of layer 136 and pushing inward. The clamps move with slider plate 124 and stripper bar 120, and release layer 136 once layer 136 is placed on pallet 102 or a layer on pallet 102.

Apparatus 100 shown in FIG. 1 further includes a second mast 210 connected to a top platen 150 so that top platen 150 moves vertically. As also shown in FIG. 2, top platen 150 includes a platen arm 152 which moves vertically, and a platen axle 154 connecting platen arm 152 to a platen pad frame 156. Platen pad frame 156 supports a platen pad 158 made of a compressible or incompressible material, such as foam, rubber, springs, or a steel plate. Platen pad frame 156, pad 158, and platen axle 154 are rotatable about a vertical axis through axle 154. Top platen 150 may be connected to apparatus 100 in a variety of other ways. For example, top platen 150 may be connected to mast 110, palletizer 112, or slider plate frame 118.

A description of a method of building and wrapping a load according to an aspect of the present invention, and using apparatus 100 shown in FIG. 1, will now be provided. A controller such as a microprocessor or an electromechanical device may be used to actuate the apparatus. Conveyor 105 transports load units 36 towards pusher bar 41. Once a predetermined number of load units 36 to create a row of load units 36 are positioned In front of pusher bar 41, pusher bar 41 pushes the row of load units 36 onto slider plate 124. This is repeated until a layer 136 of load units 36 is positioned on slider plate 124. Slider plate 124 is then displaced horizontally from layer building area A to load building area B by its movement along guide rails 128 and 130.

Stripper bar 120 is then lowered, and front and side squeezers 140, 142, and 144, and stripper bar 120 horizontally compress the layer of load units 36. The layer is then deposited onto a pallet 102 or onto another layer of load units 36 while under the applied horizontal compressive forces. To do so, slider plate 124 is retracted from load building area B to layer building area A while stripper bar 120 is at its lowered position. Slider plate 124 may then be used to prepare a subsequent layer.

Top platen 150 then lowers to apply vertical compressive forces to the top of the layer and maintain the horizontally compressed orientation of the layer. Once top platen 150 is in place, side and front squeezers 140, 142, and 144, and stripper bar 120 release and move to a location out of the way of the wrap dispensing mechanism, usually to a location above the load. Although the horizontal compression provided by the squeezers and stripper bar is released, its effect is retained by holding the load in place with the top platen. The load is then rotated relative to mast 110 and wrap dispenser 109, such that packaging material 111 is dispensed around the layer. This process of compressing layers, placing layers onto a load, and wrapping the layers is repeated until a full load is built and wrapped. The wrapped load is then conveyed off of turntable 106, a new pallet is placed onto turntable 106, and the process of building and wrapping a load begins again.

FIGS. 2–9 show another embodiment of a method of building and wrapping a load according to an aspect of the invention. As in the FIG. 1 embodiment, load units 36 are transported by conveyor 105 towards pusher bar 41, and load units 36 are placed onto slider plate 124 until a layer 136 of load units 36 is on slider plate 124. Slider plate 124 is then displaced horizontally from layer building area A to load building area B by moving along guide rails 128 and 130. Stripper bar 220 is then lowered from an at-rest position to the position shown in FIG. 2, and slider plate 124 is returned to layer building area A by its movement along guide rails 128 and 130, as also shown in FIG. 2.

Figures 3, 3A:
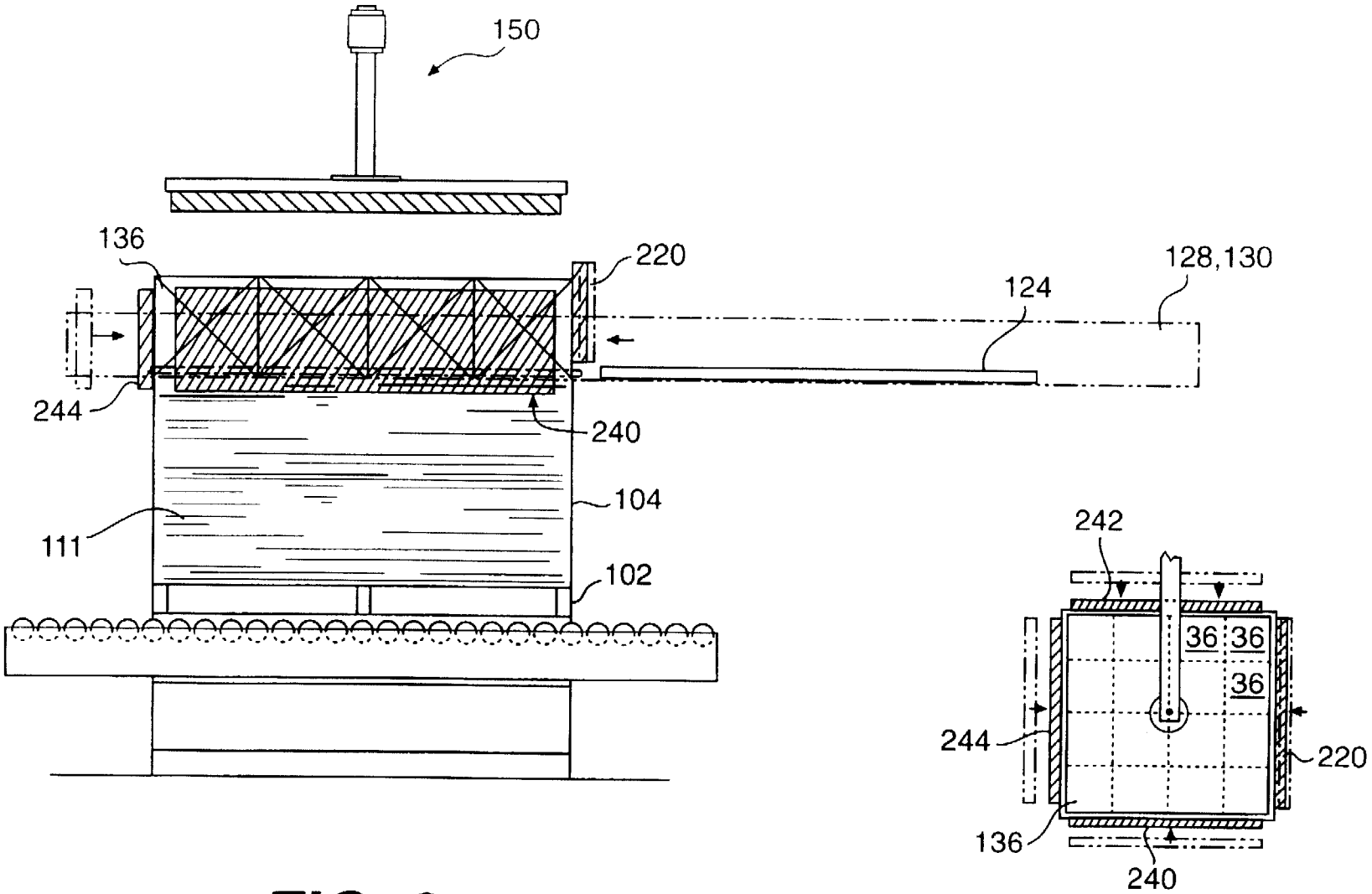

FIG. 2 shows a layer 136 of load units 36 being placed onto load 104. Layer 136 is compressed by horizontal side squeezers 240 and 242, front squeezer 244, and a stripper bar 220. Horizontal side squeezers 240 and 242, and front squeezer 244, move from at rest positions shown in FIGS. 2 and 2A to compressing positions shown in FIGS. 3 and 3A. Horizontal side squeezers 240 and 242, front squeezer 244, and stripper bar 220 apply horizontal compression forces which eliminate spaces 145 between load units 36 of layer 136. FIGS. 2 and 2A show layer 136 before compression, and FIGS. 3 and 3A show layer 136 after compression. As can be seen in FIGS. 3 and 3A, spaces 145 no longer exist between each load unit 36.

Figures 4, 4A:
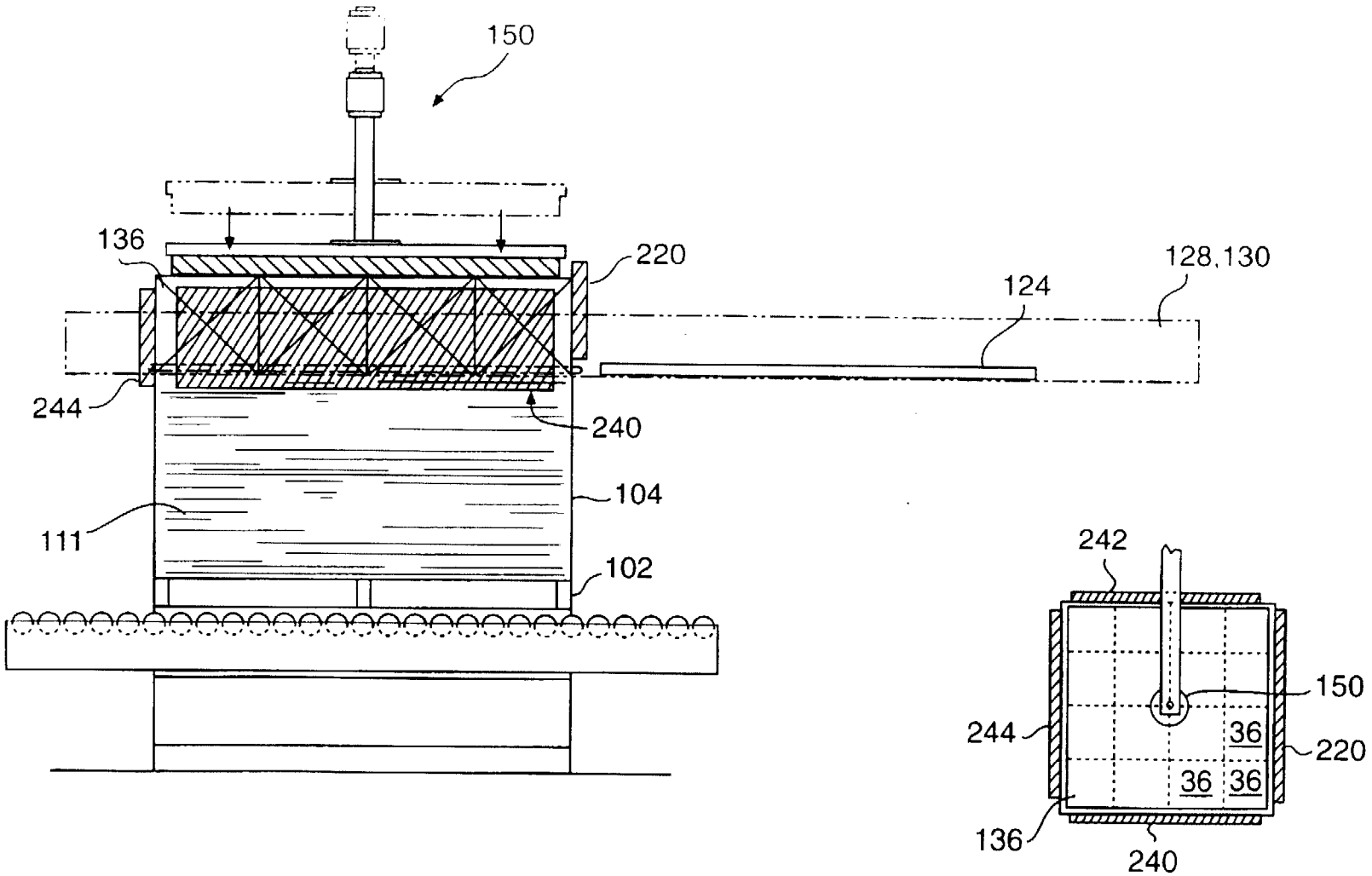
Figures 5, 5A:
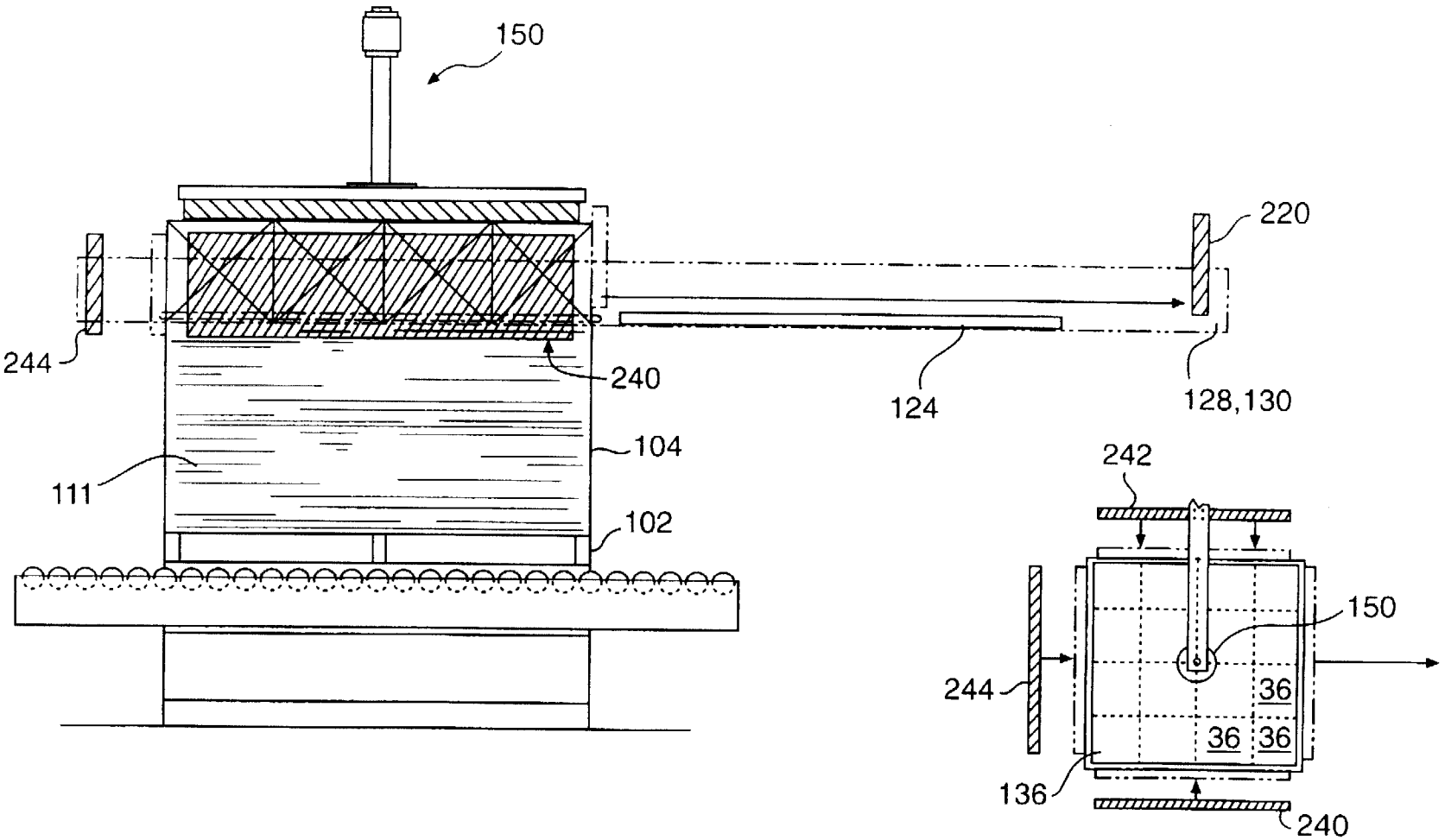
Figures 6, 6A:
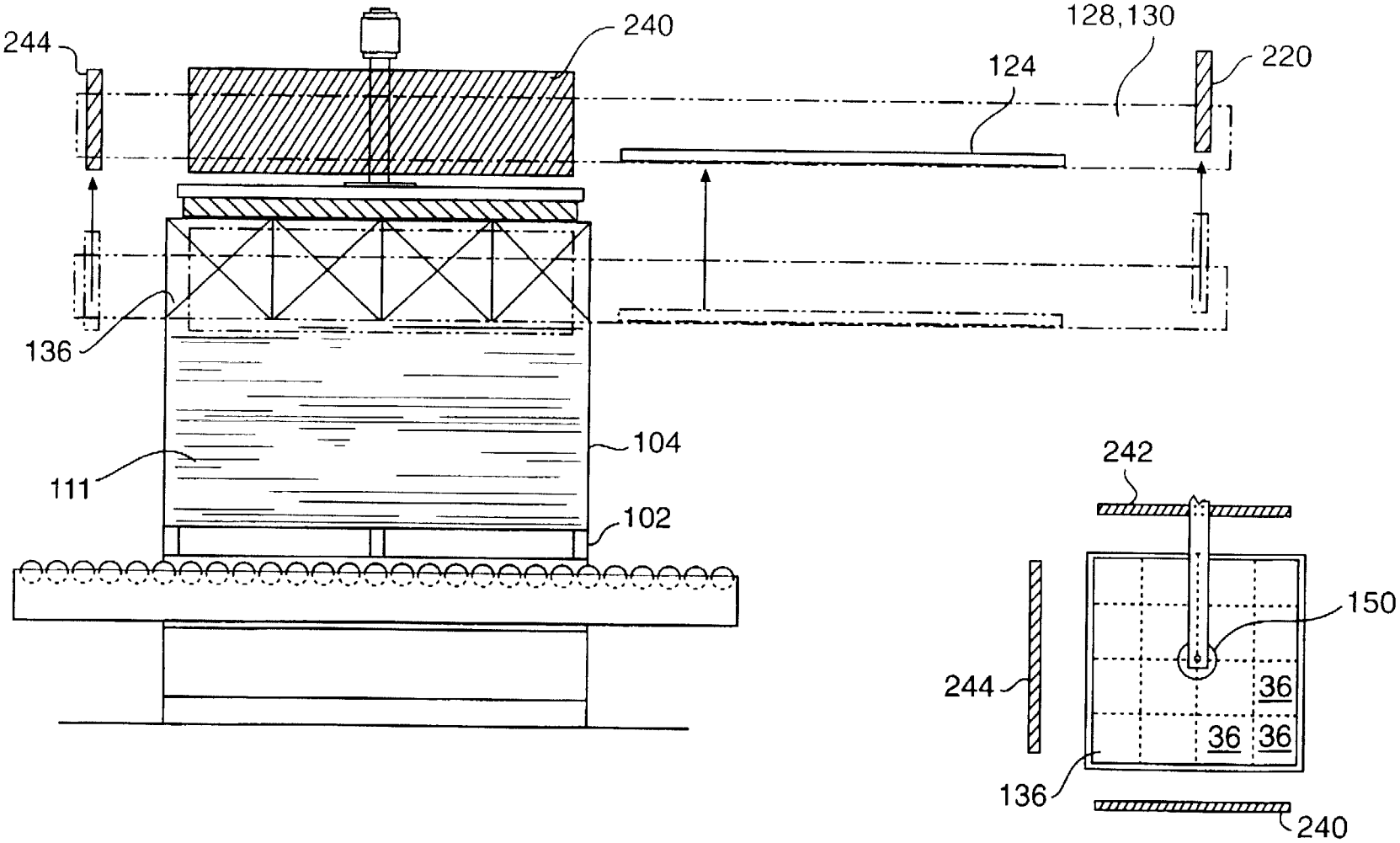

As shown in FIG. 4, while side and front squeezers 240, 242, and 244, and stripper bar 220 are applying horizontal compression forces to layer 136, vertical compression is applied to the top of the layers by top platen 150. Once horizontal compression is applied, top platen 150 is lowered to layer 136 to apply the vertical compression. Once the vertical compression is applied, side and front squeezers 240, 242, and 244, and stripper bar 220 return to their at rest positions, as shown in FIG. 5. At this point, top platen 150 holds load units 36 of layer 136 in a compressed position. Guide rails 128 and 130, stripper bar 220, and side and front squeezers 240, 242, and 244 then move vertically upwards to allow wrapping of layer 136, as shown in FIG. 6.

Figure 7A:
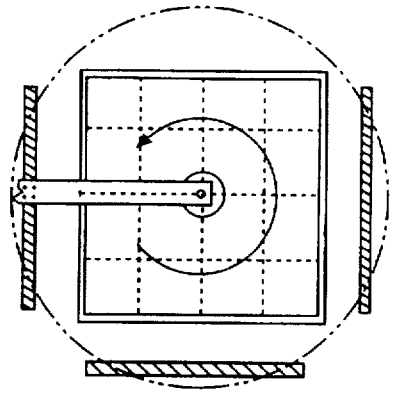
Figure 7:
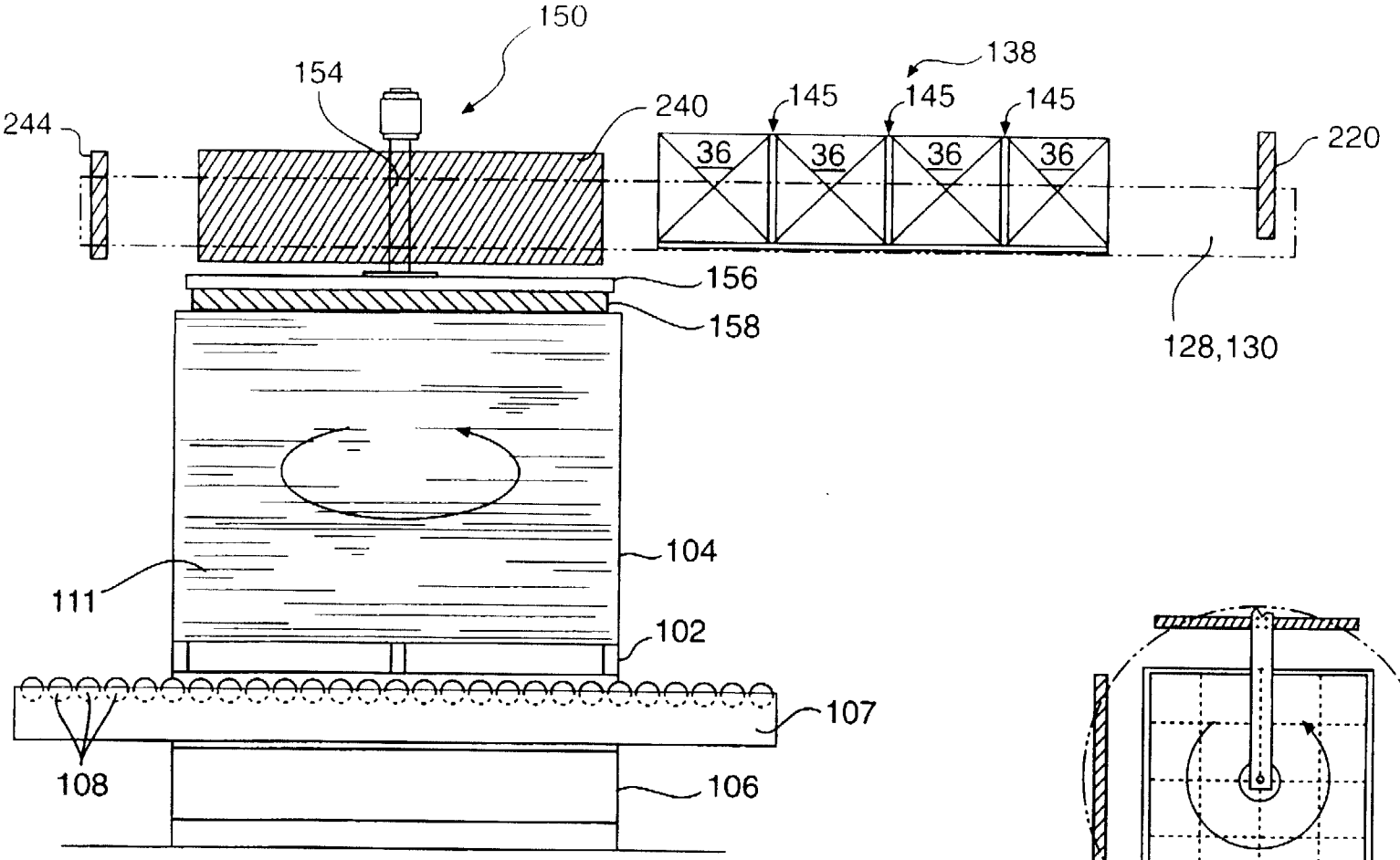

Turntable 106 is then rotated, as shown in FIG. 7, and stretch wrap packaging material 111 is dispensed from stretch wrap packaging material dispenser 109. The load is wrapped by the relative rotation of load 104 with respect to packaging material 111 being supplied from stretch wrap packaging material dispenser 109. During the wrapping, platen 150 continues to apply vertical compression to layer 136, and platen axle 154, platen pad frame 156, and platen pad 158 rotate with the load while platen arm 152 remains stationary. As shown in FIG. 7, during the wrapping operation, the layer building operation continues in layer building area A. A subsequent layer 138 of load units 36 is prepared on stripper plate 124.

Figure 8:
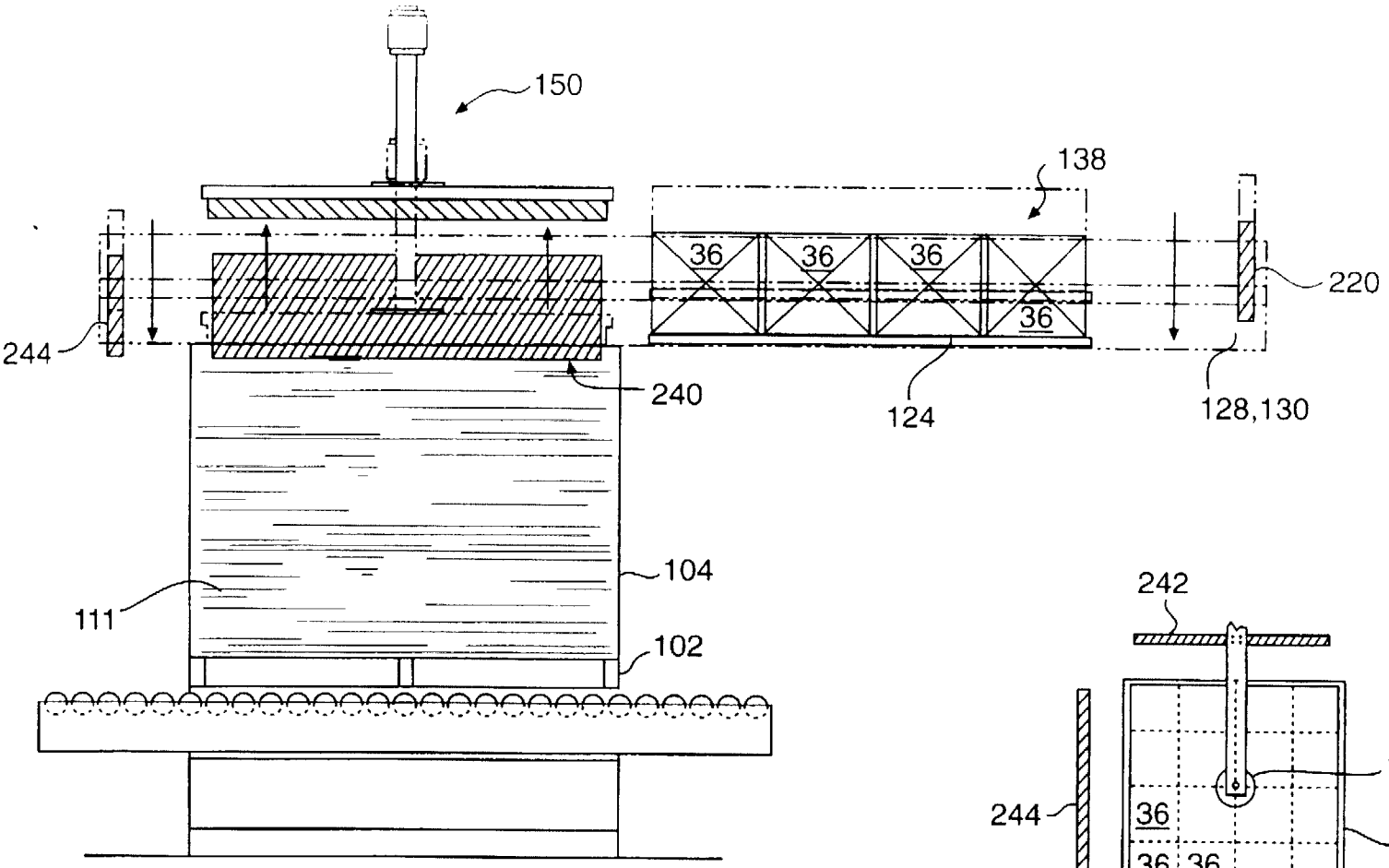
Figure 8A:
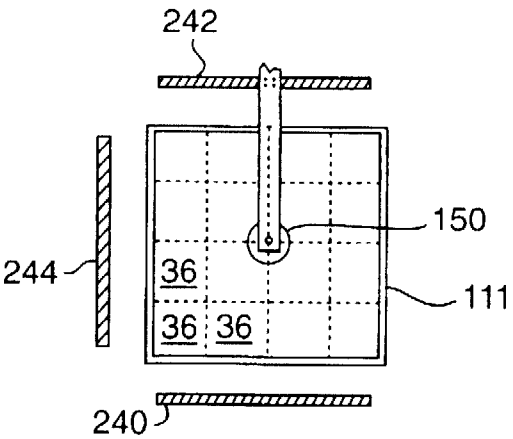
Figures 9, 9A:
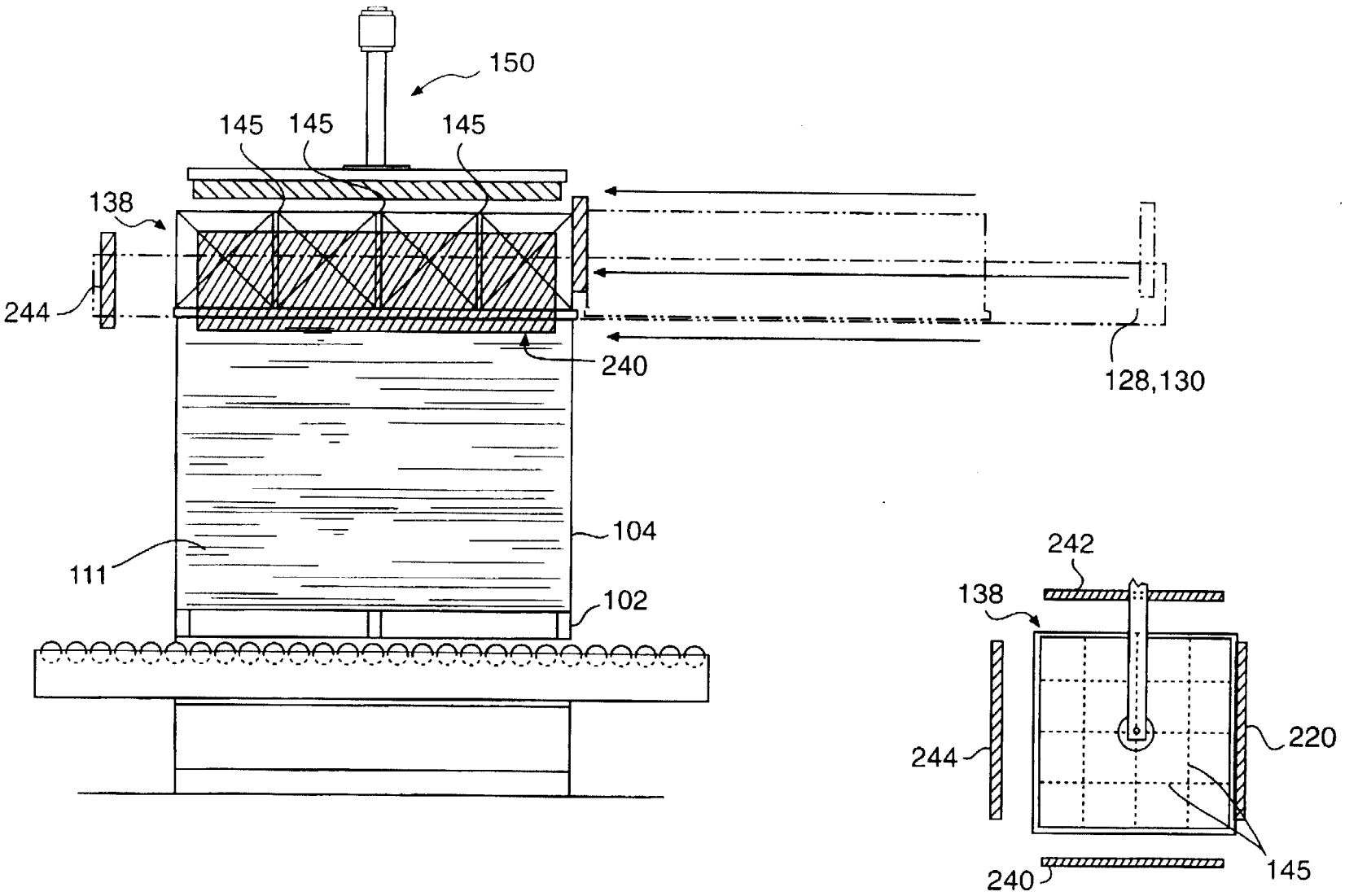

After layer 136 is fully wrapped, top platen 150 releases and moves vertically upwards to its at rest position, and stripper bar 220, and side and front squeezers 240, 242, and 244 also return to their at rest positions. Layer 138 is then deposited onto layer 136, as shown in FIGS. 8 and 9, preferably in a column stacked orientation, where the load unit edges for each layer are aligned, rather than interlocked. The above-described process for compressing and wrapping layer 136 is then repeated for layer 138, and is repeated further until load 104 is built to a desired height and wrapped. The wrapped load 104 is then conveyed off of turntable 106, a new pallet 102 is placed onto turntable 106, and the process of building and wrapping begins again.

Figure 10:
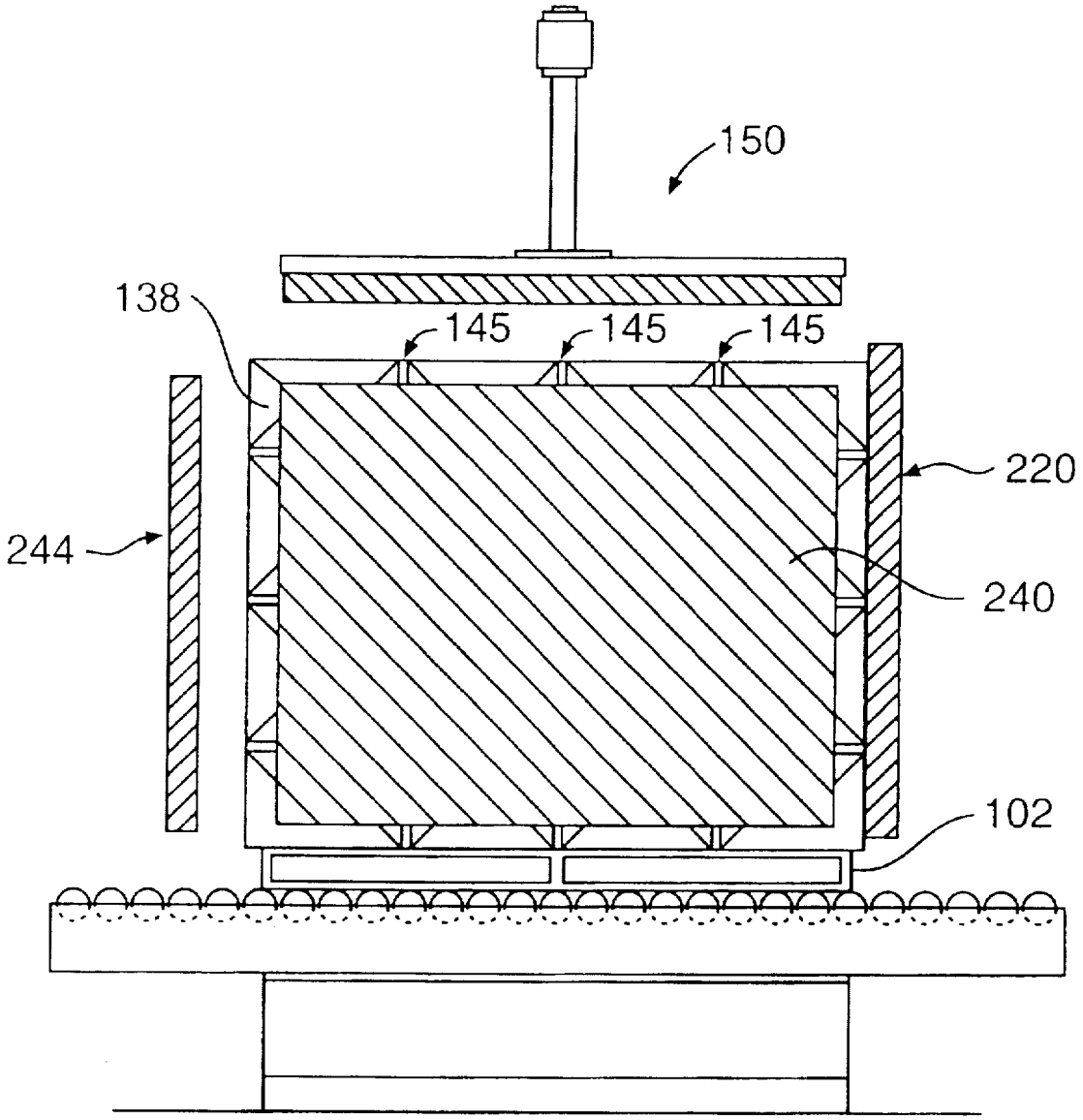
FIG. 10 is a side view of an alternative embodiment of the load building and wrapping apparatus according to the present invention.

As an alternative embodiment to those just described, the layers of load units may be built and transported to the load building as above, but the layers are not wrapped until a full load is built. As shown in FIG. 10, once the desired number of layers have been placed upon a pallet, side, front, and back squeezers of a height approximately equal to the height of the load, apply horizontal compression to the entire load. While the horizontal compression is being applied, vertical compression from a top platen may or may not be applied. If vertical compression is applied, the side, front, and back squeezers would be retracted vertically so that the load is then wrapped. If vertical compression is not applied; the load may be wrapped while the side, front, and back squeezers continue to apply a horizontal force. The packaging material would wrap over the side, front, and back squeezers. Once the load is wrapped, the side, front, and back squeezers would be retracted vertically and the packaging material would form around the load.

It will be apparent to those skilled in the art that various modifications and variations can be made in the load building and wrapping apparatus and related method of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of building and stretch wrapping loads of layers of load units, the method comprising the steps of:

providing at least one layer of load units in a load building and wrapping area;

applying horizontal compression to the at least one layer;

subsequently applying vertical compression to the at least one layer while applying the horizontal compression;

releasing the horizontal compression while retaining the vertical compression;

rotating the at least one layer relative to a packaging material dispenser to apply packaging material around the at least one layer while retaining the vertical compression; and releasing the vertical compression.

2. The method of claim 1, further comprising repeating all the steps until a multi-layer load is built and wrapped.

3. The method of claim 1, wherein the providing step provides load units to form a column-stacked array of load units.

4. The method of claim 1, wherein the providing step includes transporting a layer of load units by a slider plate from a layer building area to the load building and wrapping area.

5. The method of claim 4, further comprising the step of preparing a second layer of load units onto the slider plate while the at least one layer of load units is rotated relative to the packaging material dispenser.

6. The method of claim 1, wherein the horizontal compression is applied by horizontally movable squeezer plates.

7. The method or claim 1, wherein the vertical compression is applied by a vertically movable platen.

8. The method of claim 7, wherein the platen rotates relative to the packaging material dispenser during the rotating step.

9. The method of claim 1, wherein the providing step includes providing more than one layer of load units in the load building and wrapping area, and wherein the horizontal compression applying step includes applying horizontal compression to the more than one layer.

10. The method of claim 1, wherein the step of applying horizontal compression occurs prior to the step of providing at least one layer in the load building and wrapping area.

11. The method of claim 1, wherein the step of providing at least one layer in the load building and wrapping area occurs prior to the step of applying horizontal compression.

12. The method of claim 6, wherein the horizontally moveable squeezer plates are vertically moveable so as to not impede the application of packaging material during the rotating step.

13. An apparatus for building and wrapping a load comprising:

a packaging material dispenser for dispensing packaging material;

means for providing relative rotation between the packaging material dispenser and the load in a load building and wrapping area for wrapping the packaging material around the load;

a layer transporter for transporting load layers from the layer building area to the load building and wrapping area;

a side compressor for applying horizontal compression to the load;

a vertical compressor for applying vertical compression to the load; and a controller for actuating the side compressor, subsequently actuating the vertical compressor while continuing to actuate the side compressor, subsequently deactivating the side compressor while actuating the vertical compressor and the means for providing relative rotation to wrap packaging material around the load while continuing to actuate the vertical compressor, and subsequently deactivating the vertical compressor.

14. The apparatus of claim 13, wherein the side compressor includes horizontally moveable squeezers.

15. The apparatus of claim 14, wherein the horizontally moveable squeezers are movable in both a vertical and a horizontal direction.

16. The apparatus of claim 13, wherein the vertical compressor includes a platen movable in a vertical direction.

17. The apparatus of claim 16, wherein the platen includes a rotatable plate.

* * * * *